US011081825B1

(12) United States Patent
Lai et al.

(10) Patent No.: US 11,081,825 B1
(45) Date of Patent: Aug. 3, 2021

(54) DOUBLE-POLE BUTTING CONNECTOR

(71) Applicant: AVERTRONICS INC., Taichung (TW)

(72) Inventors: Austin Lai, Taichung (TW); Chao-I Chien, Taichung (TW); Chi-I Lai, Taichung (TW); Chung-Jen Chang, Taichung (TW)

(73) Assignee: AVERTRONICS INC., Taichung (TW)

( * ) Notice: Subject to any disclaimer, the term of this patent is extended or adjusted under 35 U.S.C. 154(b) by 0 days.

(21) Appl. No.: 16/908,594

(22) Filed: Jun. 22, 2020

(51) Int. Cl.

| | |
|---|---|
| ***H01R 13/22*** | (2006.01) |
| ***H01R 13/05*** | (2006.01) |
| ***H01R 13/622*** | (2006.01) |
| ***H01R 13/502*** | (2006.01) |
| ***H01R 13/64*** | (2006.01) |
| ***H01R 13/11*** | (2006.01) |
| ***H01R 103/00*** | (2006.01) |

(52) U.S. Cl.
CPC ..... *H01R 13/22* (2013.01); *H01R 13/05* (2013.01); *H01R 13/11* (2013.01); *H01R 13/502* (2013.01); *H01R 13/622* (2013.01); *H01R 13/64* (2013.01); *H01R 2103/00* (2013.01)

(58) Field of Classification Search
CPC ..... H01R 13/22; H01R 13/05; H01R 13/502; H01R 13/622; H01R 13/11; H01R 13/64; H01R 13/28; H01R 2103/00
See application file for complete search history.

(56) References Cited

U.S. PATENT DOCUMENTS

| | | | | |
|---|---|---|---|---|
| 5,035,639 | A * | 7/1991 | Kilpatrick | H01R 13/28 439/290 |
| 8,696,382 | B2 * | 4/2014 | Patel | H01R 12/724 439/607.1 |
| 9,437,961 | B1 * | 9/2016 | Smajda | H01R 13/5219 |
| 2018/0301842 | A1 * | 10/2018 | Somanathapura Ramanna | H01R 24/84 |

* cited by examiner

*Primary Examiner* — Briggitte R. Hammond

(57) ABSTRACT

A double-pole butting connector has a male connector and a female connector. The male connector has at least one first pole with a first front side and a first back side. The female connector having at least one second pole with a second front side and a second back side. The first pole and the second pole have an identical thickness. The second pole is placed in an insertion groove, and the insertion groove has a positioning strip facing the second back side of the second pole, and the positioning strip makes contact with the second back side with an allowable deformation angle between the positioning strip and the second back side.

10 Claims, 13 Drawing Sheets

DOUBLE-POLE BUTTING CONNECTOR

BACKGROUND OF INVENTION

Field of Invention

The present invention relates to an electronic connector, and more particularly to a double-pole butting connector.

Description of Related Art

The conventional electrical connector is a connection unit for electronic signals and power supplies, and its main function is to provide electrical connections for various electronic devices, so that signals can be accurately transmitted during operation. Whether it is power supply or signal transmission, it is necessary to maintain a stable connection, bad contacts will have the risk of increased resistance or power jump. When the connector is prone to vibration or swing at both ends, it requires to provide higher connection stability. Commonly, the male connector is provided with pole terminals (with blade or plate shape), and the female connector is provided with a spring clamp terminal, which clamps the pole terminal through the high elasticity of the spring, thereby allowing more dimensional errors during production and maintaining production yield of the connector. However, it is not difficult to observe that the above-mentioned conventional structure has some shortcomings. The main reason is that the spring clamp terminal requires more assembly space for stable connection. Therefore, the connector is limited by the terminals and cannot be further reduced in size. Furthermore, the dual poles docking method is not commonly used due to the insufficient flexibility of the dual poles. The incorrect distance between the dual poles can cause poor contact or insufficient conductive contact area. As result, dimensional accuracy requirements of the dual-pole butt-connector cannot be achieve with low-cost, small size, high current resistance and high yield.

Therefore, it is desirable to provide a double-pole butting connector to mitigate and/or obviate the aforementioned problems.

SUMMARY OF INVENTION

An objective of present invention is to provide a double-pole butting connector, which is capable of improving the above-mention problems.

In order to achieve the above mentioned objective, a double-pole butting connector has a male connector and a female connector. The male connector has at least one first pole with a first front side and a first back side. The female connector having at least one second pole with a second front side and a second back side. The first pole and the second pole have an identical thickness. The second pole is placed in an insertion groove, and the insertion groove has a positioning strip facing the second back side of the second pole, and the positioning strip makes contact with the second back side with an allowable deformation angle between the positioning strip and the second back side.

Other objects, advantages, and novel features of invention will become more apparent from the following detailed description when taken in conjunction with the accompanying drawings.

DETAILED DESCRIPTION OF PREFERRED EMBODIMENT

Figure 1:
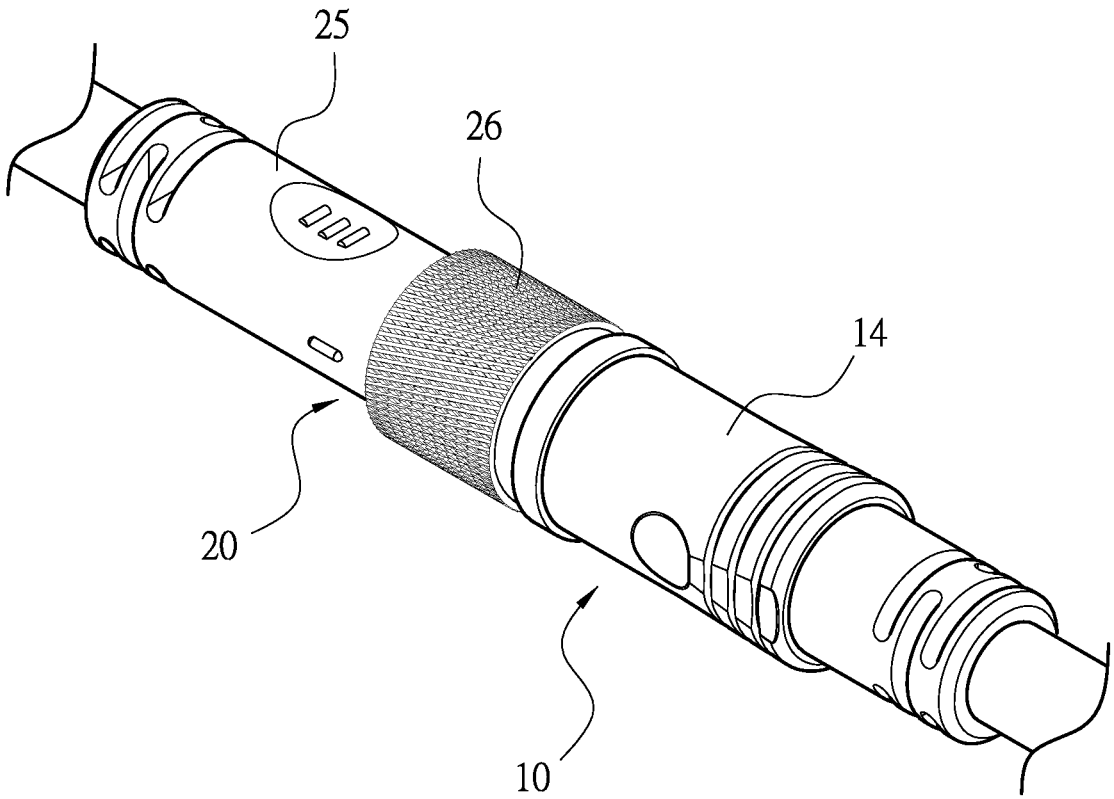
FIG. 1 is a perspective view of a preferred embodiment according to the present invention.
Figure 2:
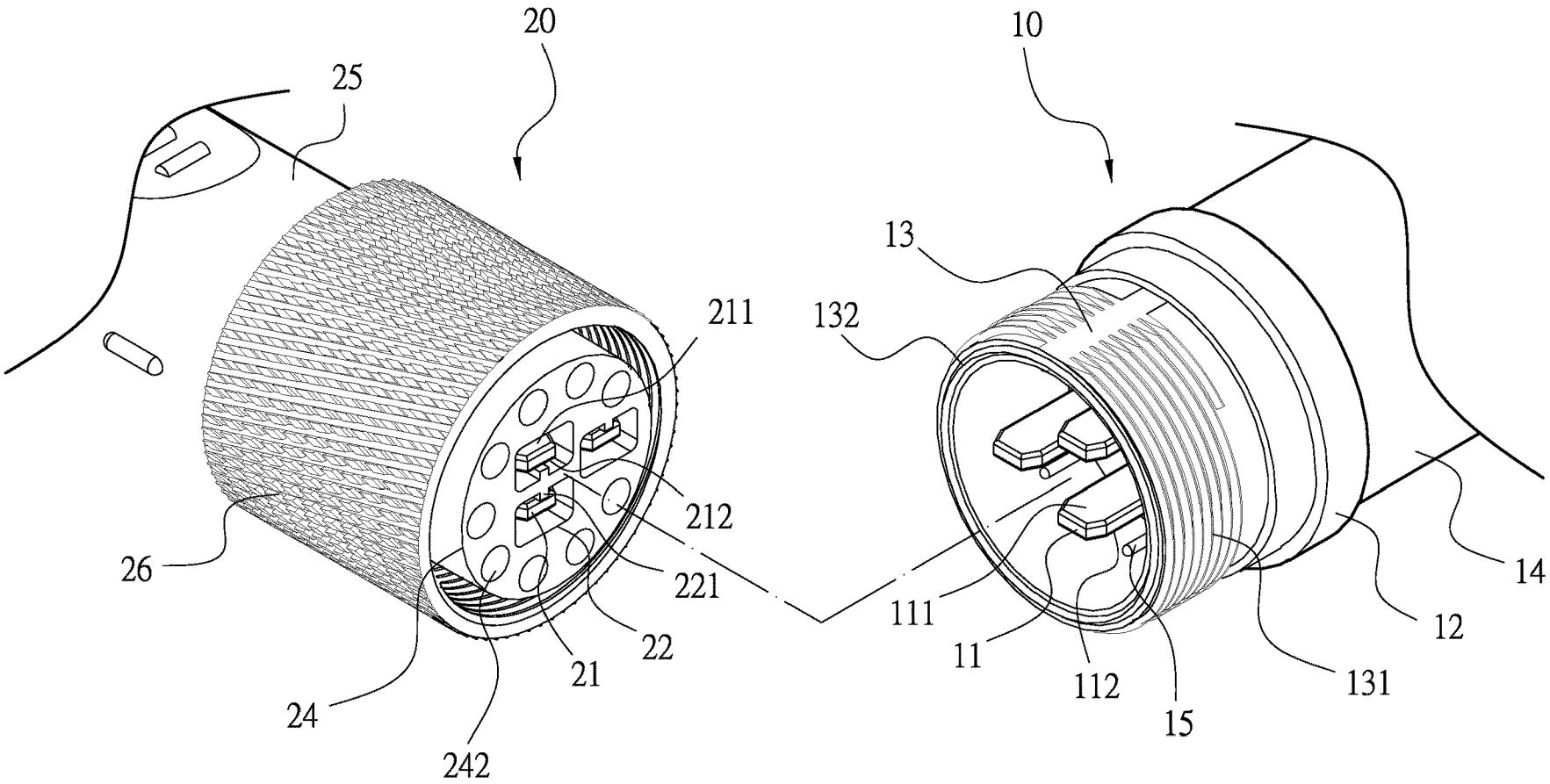
FIG. 2 is an exploded perspective view of the preferred embodiment according to the present invention.
Figure 3:
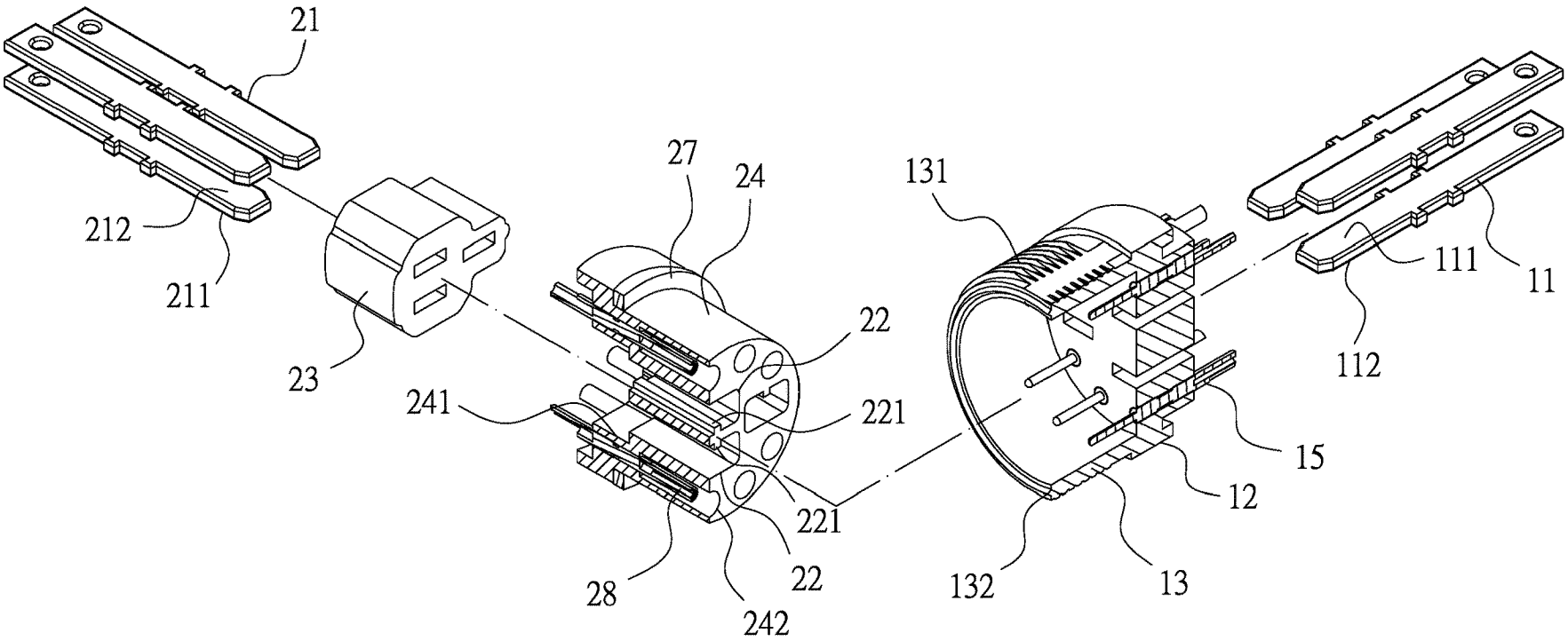
FIG. 3 is a partial exploded view of the preferred embodiment according to the present invention.
Figure 4:
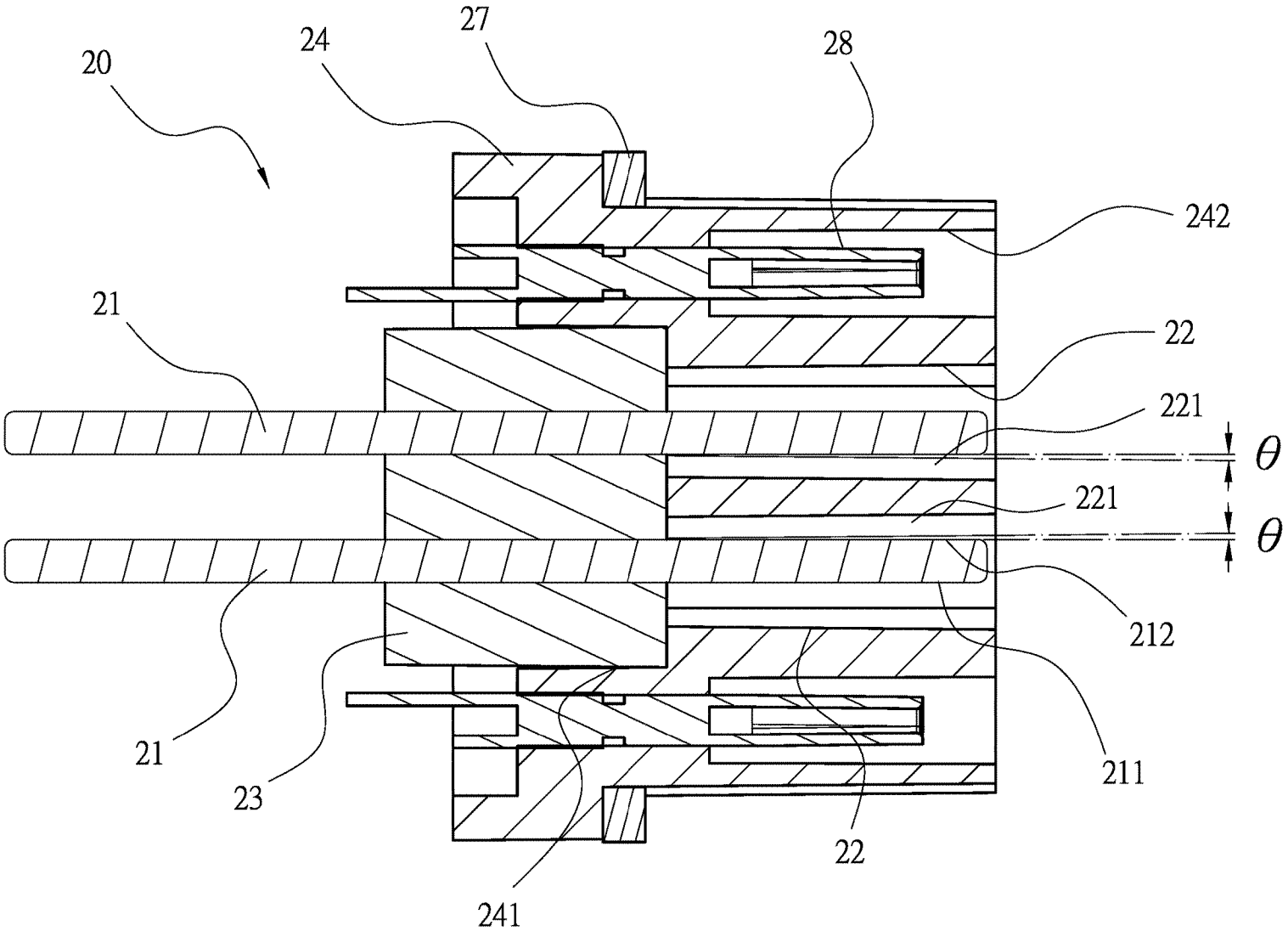
FIG. 4 is a longitudinal cross-sectional view of the female connector of the preferred embodiment according to the present invention.
Figure 5:
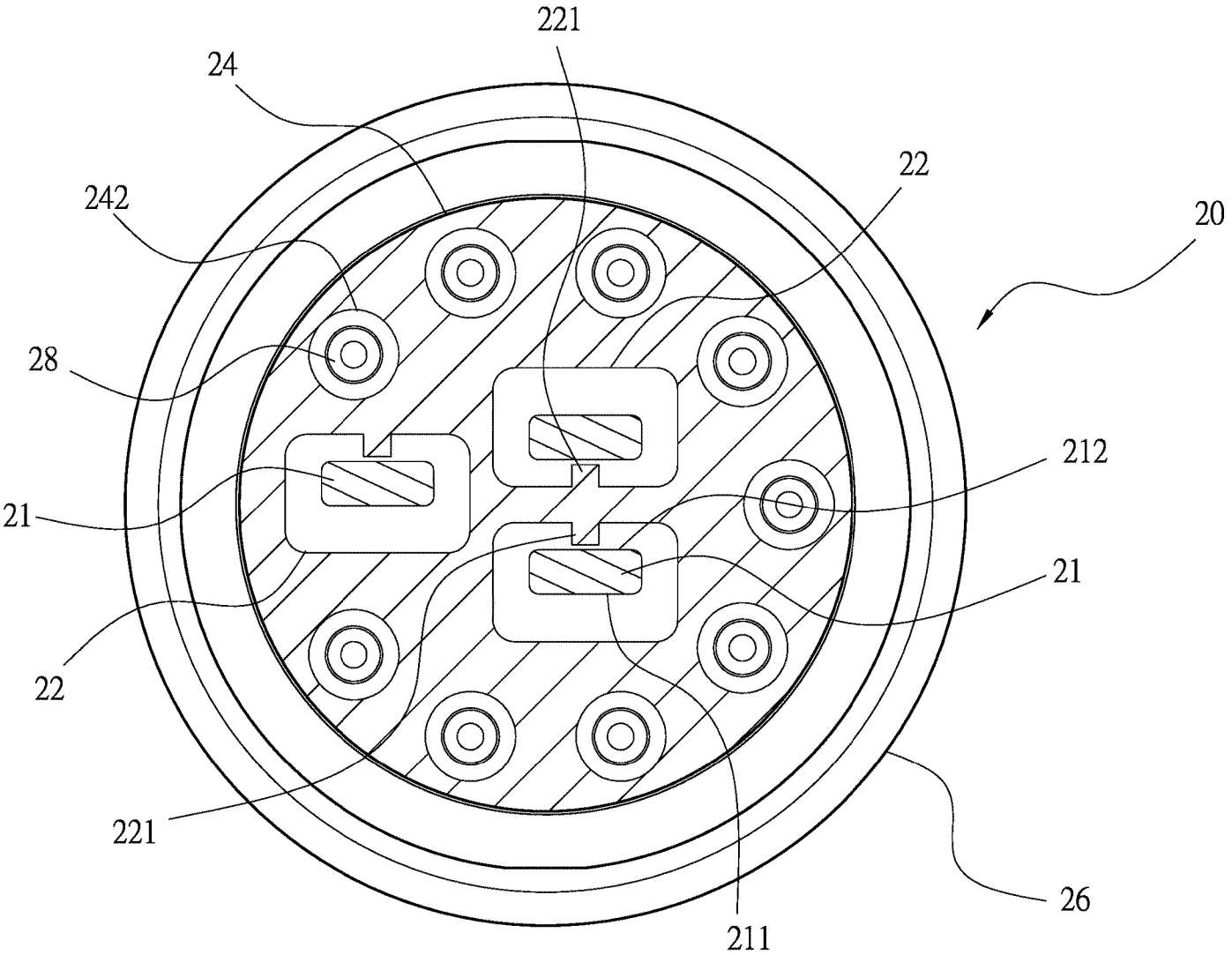
FIG. 5 is an opposite cross-sectional view of the female connector of the preferred embodiment according to the present invention.
Figure 6:
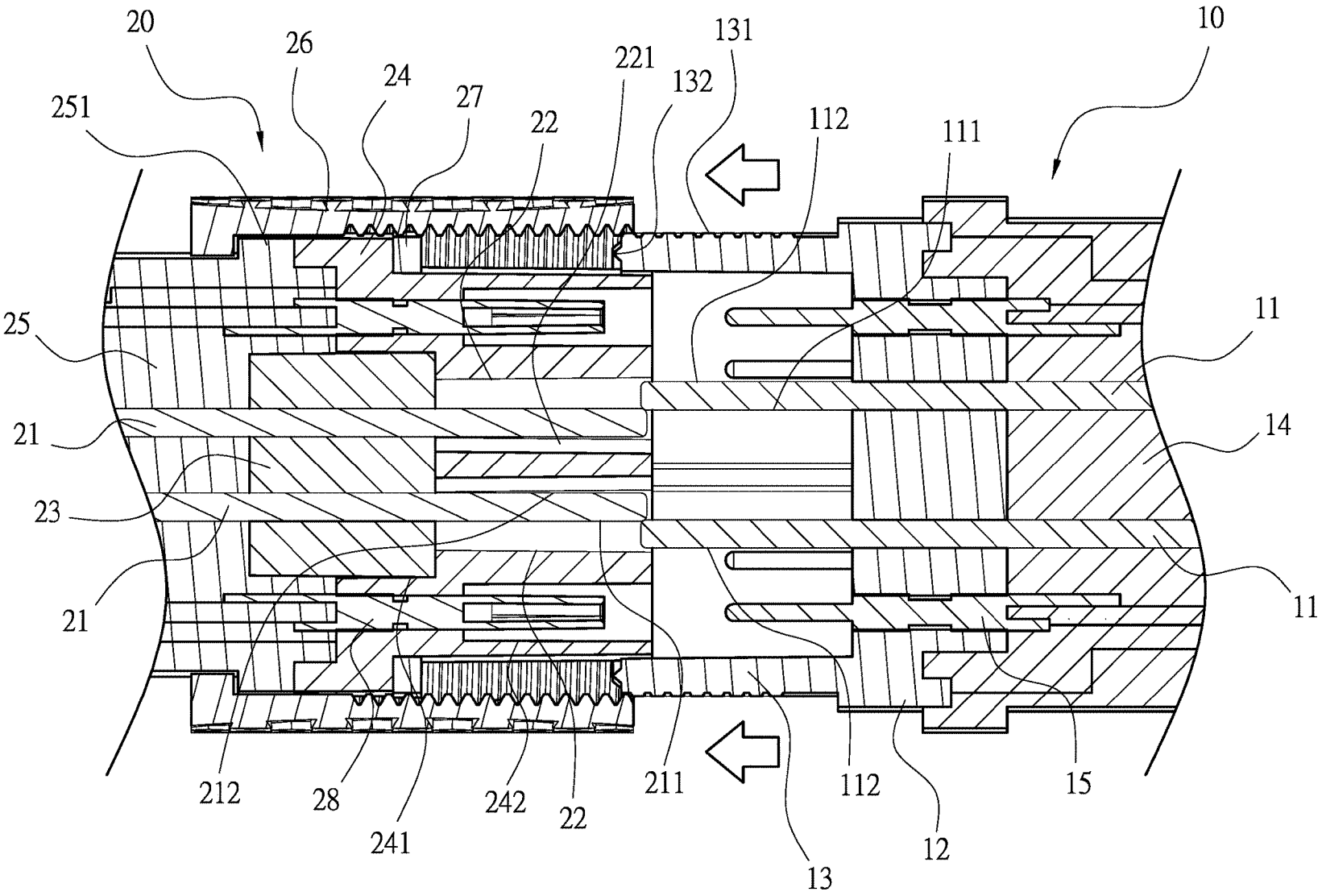
FIG. 6 is a schematic view of the use state of the preferred embodiment according to the present invention.

Please refer to FIGS. 1-5. A double-pole butting connector comprises: a male connector 10 and a female connector 20. The male connector 10 has at least one first pole 11 with a first front side 111 and a first back side 112. The male connector 10 utilizes a sleeve 12 to surround the first pole 11, and the sleeve 12 further has a ring 13 framing the first pole 11. The female connector 20 has at least one second pole 21, and the second pole 21 has a second front side 211 and a second back side 212. The first pole 11 and the second pole 21 have an identical thickness for lower manufacture cost. The first pole 11 and the second pole 21 are also made of the same material such that the male connector 10 and the female connector 20 can transmit the same maximum current. The second pole 21 is placed in an insertion groove 22, and the insertion groove 22 has a positioning strip 221 facing the second back side 21 of the second pole 21. The positioning strip 221 make contact with the second back side 212 of the second pole 21 with an allowable deformation angle θ between the positioning strip 221 and the second back side 212. The allowable deformation angle θ is defined between the positioning strip 221 and the second pole 21, and the allowable deformation angle is between 0.5°-1.5°, which is preferably 1°. The female connector 20 comprises a securing block 23 and a connecting set 24, the securing block 23 passes through the second pole 21. The connecting set 24 is penetrated by the insertion groove 22 and has a positioning set 241 connected to an enlarged end of the insertion groove 22. The securing block 23 is secured to the positioning set 241 and presses against an open end of the insertion groove 22 to secure relative positions of the second pole 21 and the positioning strip 221. The connecting set 24 of the female connector 20 is inserted in the ring 13 of the male connector 10, such that the first pole 11 of the male connector 10 is inserted into the insertion groove 22 of the female connector 20 which creates the contact between the first front side 111 of the first pole 11 and the second front side 211 of the second pole 21. While the second pole 21 presses against the positioning strip 221, the second pole 21 pushes against the first pole 11, and a free end of the first back side 112 of the first pole 11 presses against the insertion groove 22 to squeeze the first pole 11 toward the second pole 21 and limit the elastic deformation between the first pole 11 and the second pole 21 to achieve a full contact between the first front side 111 and the second front side 211. Please refer to FIGS. 2 and 3 with FIG. 8. The sleeve 12 is further provided with an outer threaded section 131 on the ring 13, and an opposite end of the sleeve 12 is mounted with a male end body 14. An end of the connecting set 24 secured to the securing block 23 is mounted with a female end body 25 jacketed with a nut 26 adjacent to a stopping ring 251, and the nut 26 is screwed onto the outer threaded section 131. Therefore, the male connector 10 and the female connector 20 are locked together. The connecting set 24 is jacketed with a sealing ring 27, the sealing ring 27 is further provided with a sharp ring 132 at an open end, and the sharp ring 132 is configured for squeezing the sealing ring 27 to provide seal effect between the connecting set 24 and the ring 13. Therefore, the nut 26 provides buffer between the outer threaded section 131 and the sealing ring to prevent deformation.

Moreover, the sleeve 12 is provided with a plurality of signal needles 15, and the connecting set 24 is provided with a plurality of through holes 242 having a plurality of signal posts 28. When the male connector 10 and the female connector 20 engage together the signal needles 15 and the signal posts 28 are electrically connected. The second poles 21 are symmetrically placed in the connecting set 24 of the female connector 20, and the signal posts 28 are placed around the second poles 21.

For the actual use, please continue to see from FIG. 4 to FIG. 9. When the male connector 10 and the female connector 20 are plugged together, the ring 13 of the sleeve 12 of the male connector 10 sleeves onto the connecting set 24 of the female connector 20. While the first poles 11 are inserted into the insertion groove 22 of the connecting set 24, the free ends of the first poles 11 and the second poles 21 are squeezed with each other, through the elastic deformation of both the first poles 11 and the second poles 21, the second poles 21 are bent toward the positioning strip 221. When the second back side 212 of the second pole 21 is completely pressed against the positioning strip 221 to effectively prevent the second poles 21 from being deformed excessively and detaching from the first pole 11. Also, the second front sides 211 of the second poles 21 are also pressed to the first front sides 111 of the first poles 11. When the male connector 10 and the female connector 20 are completely engaged, the first poles 11 deforms toward the first back side 112, so that the free ends of the first back sides 112 of the first pole 11 are pressed against the inner wall surface of the insertion groove 22 to prevents the first poles 11 from being excessively deformed detaching from the second poles 21, which limits the amount of elastic deformation between the first poles 11 and the second poles 21. As result, the first front sides 111 and the second front sides 211 touch each other. The following benefits can be obtained with the structure of the above specific embodiment: 1. The male connector 10 and the female connector 20 are designed to form a double-pole butting connection, whereby more power terminals can be set in a limited space, and the face and face contact of the first poles 11 and the second poles 21 allows the male connector 10 and the female connector 20 to be suitable for higher currents, which effectively reduces the volume of the connector under the same rated current state. 2. The female connector 20 further has the positioning strip 221 in the insertion groove 22 is convexly provided, the positioning strip 221 is in contact with the second back side 212 at the bottom of the insertion groove 22, and the respective of the positioning strip 221 and the second pole 21 that are ends in contact and the two surfaces that are not in contact with each other form the allowable deformation angle θ. The positioning strip 221 is configured to provide abutment for the second back side 212 of the second pole 21, to prevent excessive deformation of the second pole 21 and separation from the first pole 11, so that the first front side 111 and the second front side 211 can maintain the electrical connection between the surface and the surface. Furthermore, since the positioning strip 221 is used to block the second pole 21, the first pole 11 and the second pole 21 can maintain the contact between the surface and the surface when they are closer to each other, which can improve the fault tolerance rate in production to have good quality and yield.

Figure 7:
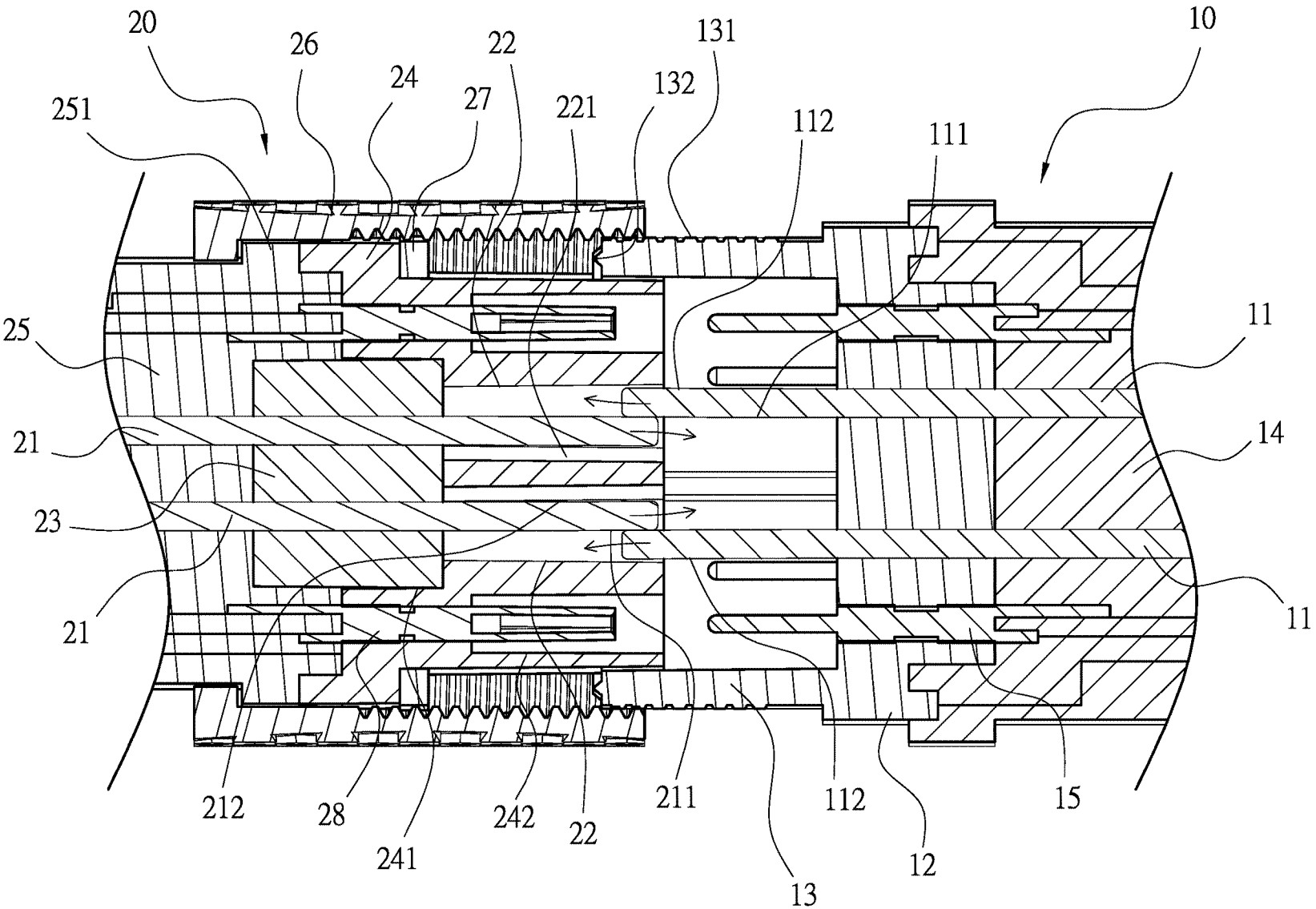
FIG. 7 is another schematic diagram of the use state of the preferred embodiment according to the present invention.
Figure 8:
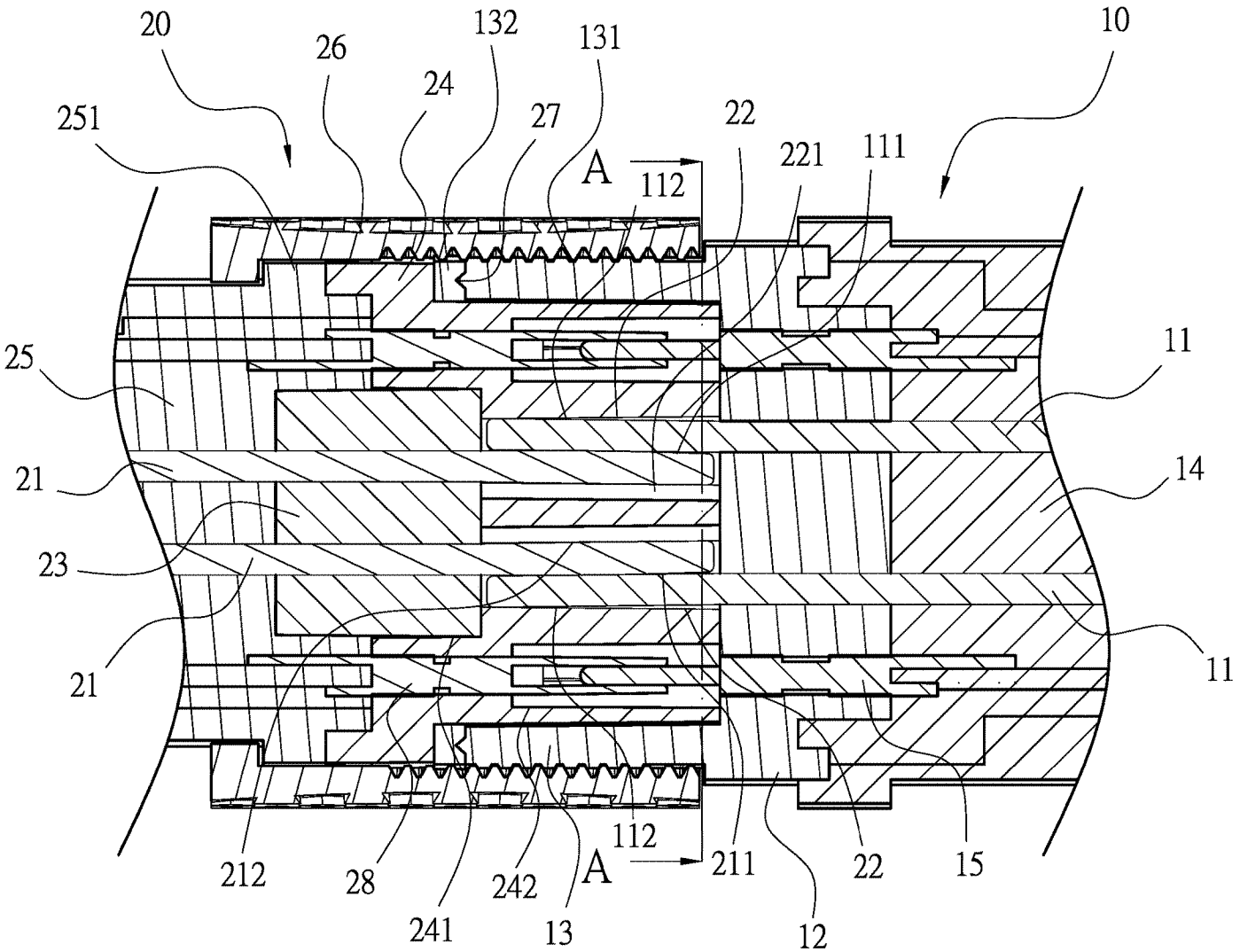
FIG. 8 is another schematic diagram of the use state of the preferred embodiment according to the present invention.
Figure 9:
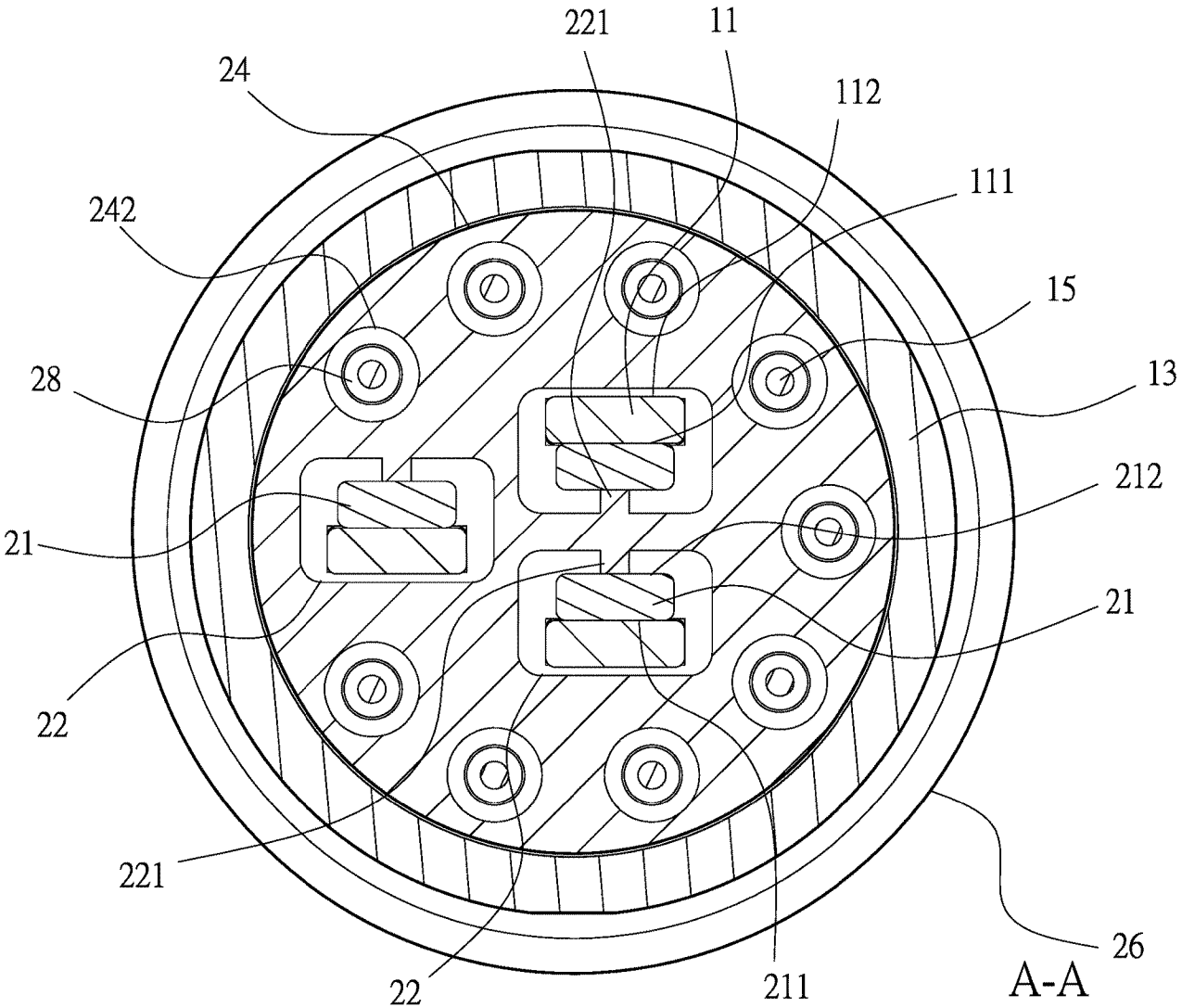
FIG. 9 is a cross-sectional view of along the line A-A shown in FIG. 8 according to the present invention.
Figure 10:
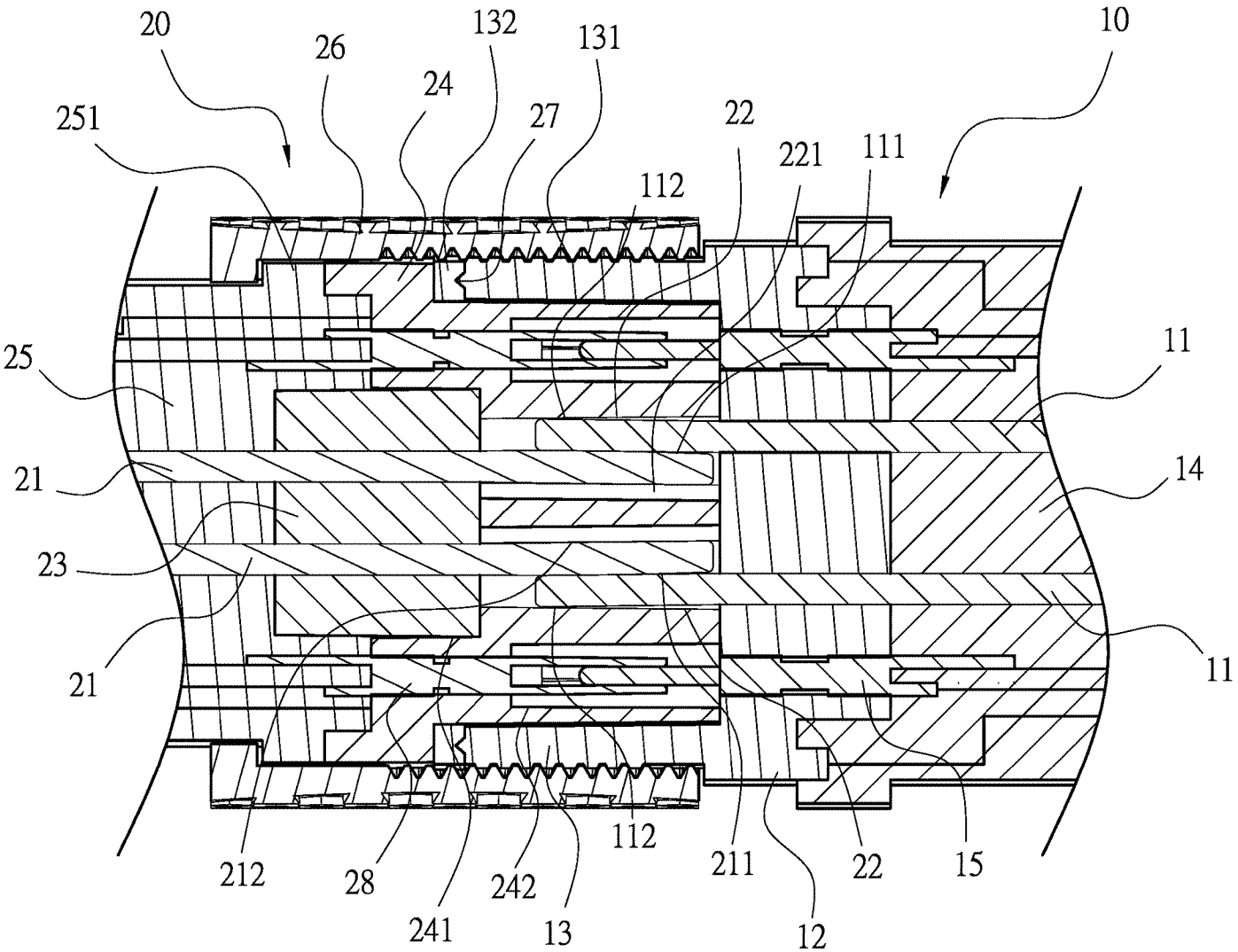
FIG. 10 is a longitudinal sectional view of another embodiment according to the present invention.

In another embodiment, as shown in FIGS. 7 and 8, the sleeve 12 of the male connector 10 passes through the first pole 11, the securing block 23 of the female connector 20 passes through the second pole 21, and the elasticity of the securing block 23 is higher than the elasticity of the sleeve 12 so the elastic deformation of the second pole 21 is higher than the elastic deformation of the first pole 11. In another embodiment, as shown in FIG. 10, the sleeve 12 of the male connector 10 passes through the first pole 11, the securing block 23 of the female connector 20 passes through the second pole 21, and the length of the second pole 21 protruding from the securing block 23 is longer than the length of the first pole 11 protruding from the sleeve 12, so that the second pole 21 has an elastic deformation greater than that of the first pole 11. With the above structural features, the second pole 21 is elastically deformed before the first pole 11 and stops deforming after the second pole 21 is pressed against the positioning strip 221 to prevent the free end of the second pole 21 from separating the first pole 11 and generating a reaction force to the first pole 11 to increase the amount of deformation. Thereby, the deformation sequence of the first pole 11 and the second pole 21 is effectively controlled, which can prevent the second pole 21 without pressing the positioning strip 221 losing the limiting effect and result in improved connection stability.

Figure 11:
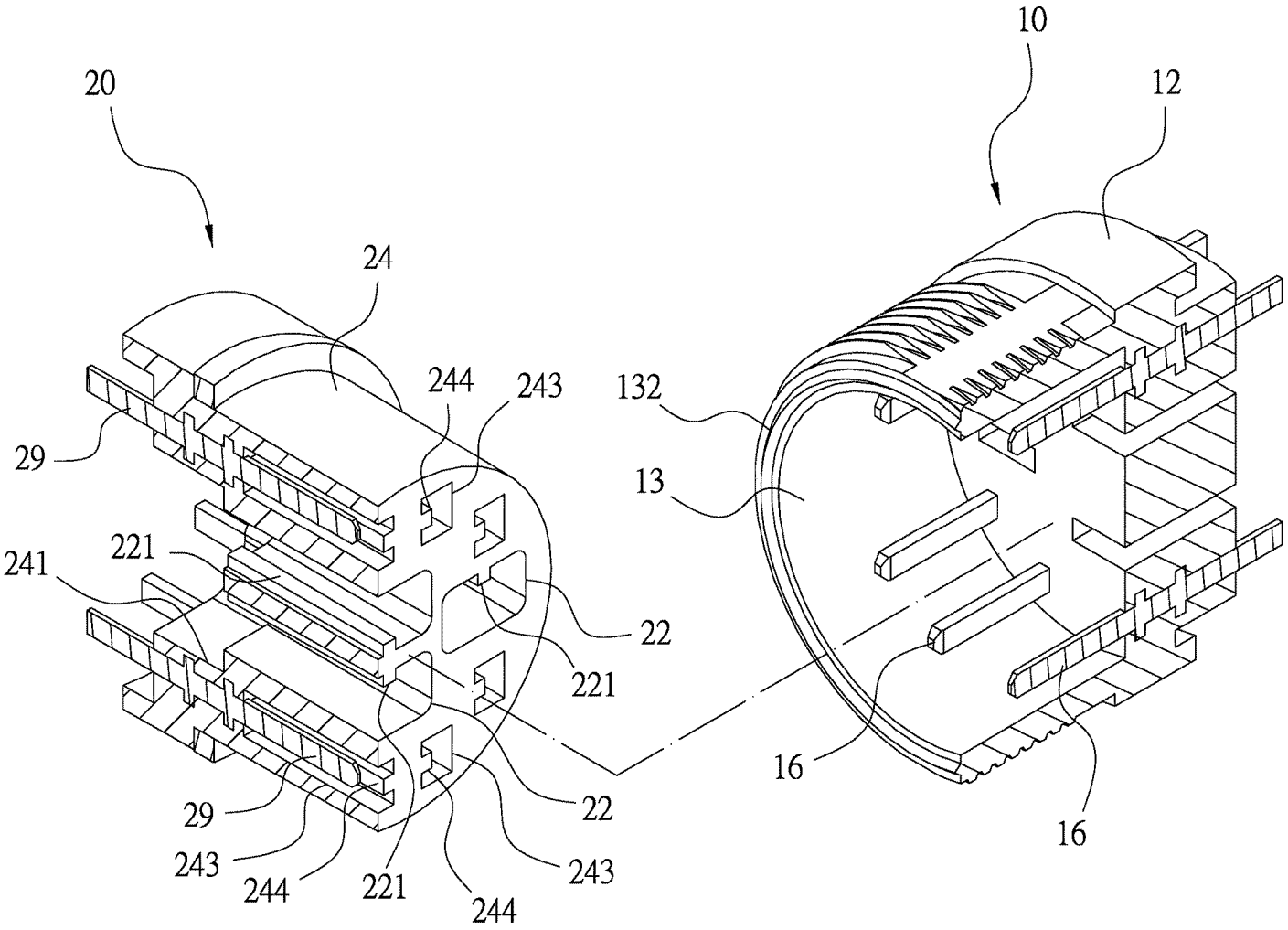
FIG. 11 is a partially exploded perspective view of still another embodiment according to the present invention.
Figure 12:
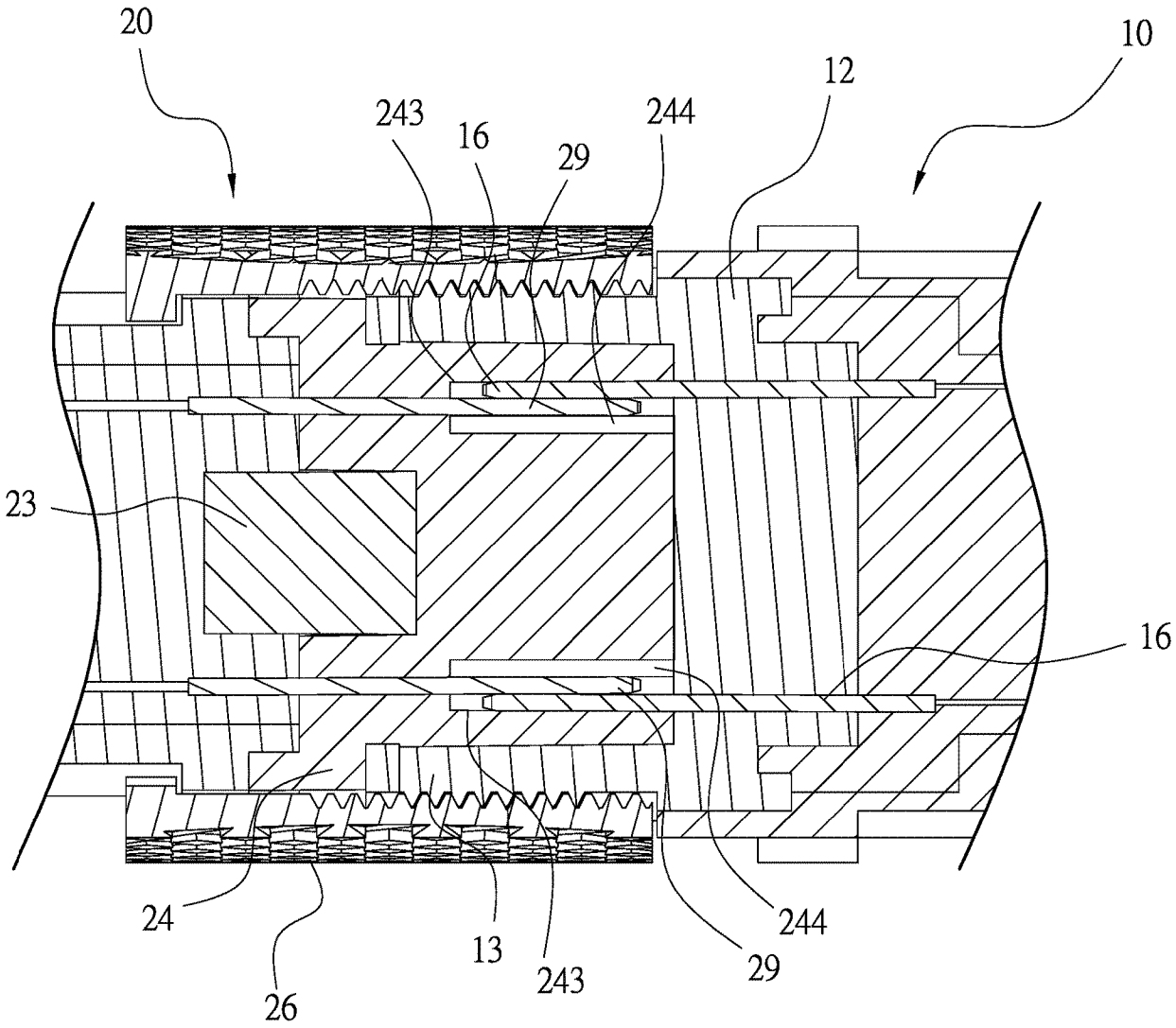
FIG. 12 is a longitudinal sectional view of still another embodiment according to the present invention.
Figure 13:
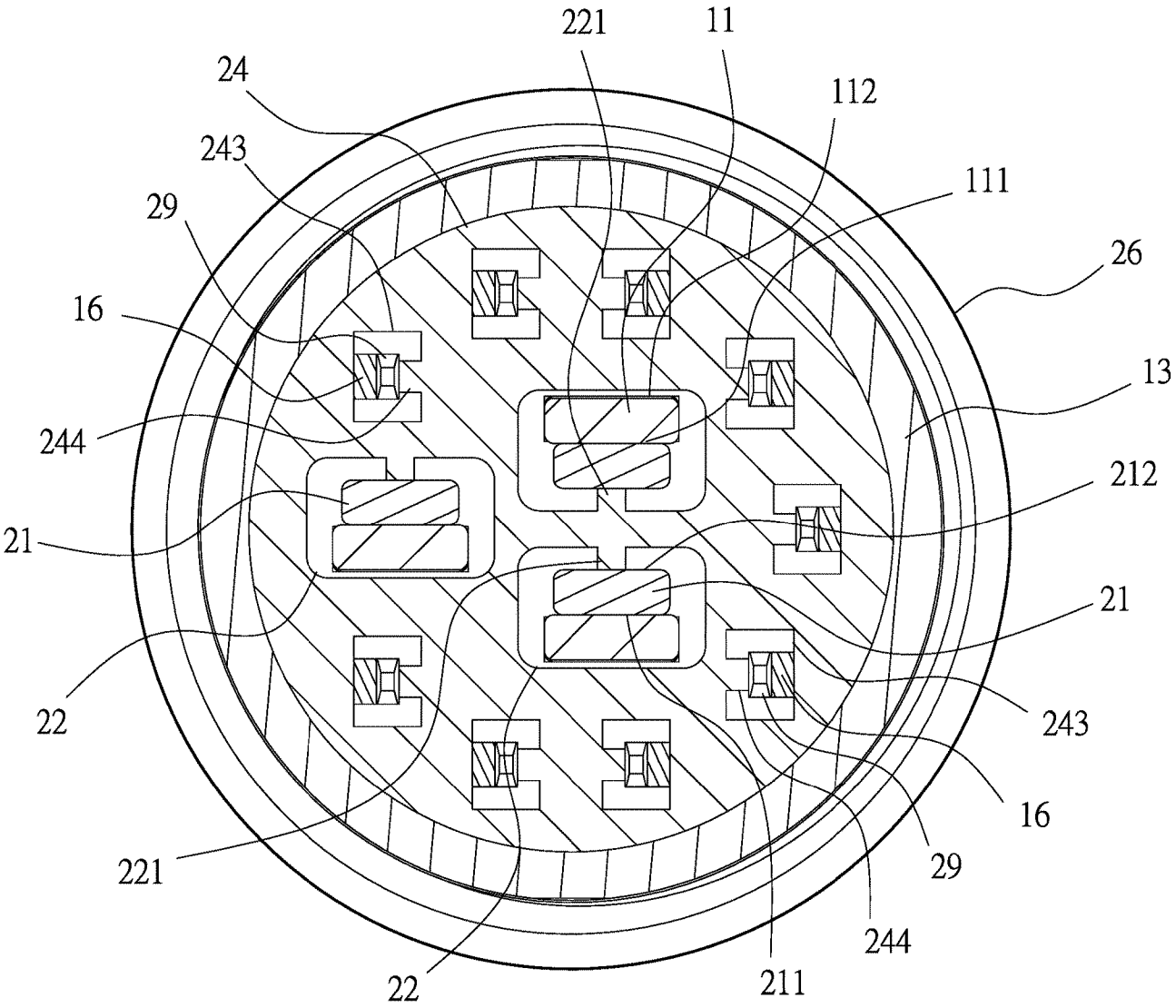
FIG. 13 is a transverse cross-sectional view of still another embodiment according to the present invention

In another embodiment, please refer to FIGS. 11, 12 and 13. The sleeve 12 of the male connector 10 is provided with the plurality of signal poles 16, the connecting set 24 of the female connector 20 is provided with the plurality of square holes 243, and the plurality of communication poles 29 pass through the connecting set 24 and are accepted in the square holes 243. Each square hole 243 is further provided with a stopping bar 244 facing the communication pole 29. When the male connector 10 and the female connector 20 engage together, the signal poles 16 and the communication poles 29 are electrically connected, and each communication pole 29 presses against the stopping bar 244 to limit flexible deformation between the signal pole 16 and the communication pole 29.

Although the present invention has been explained in relation to its preferred embodiment, it is to be understood that many other possible modifications and variations can be made without departing from the spirit and scope of invention as hereinafter claimed.

What is claimed is:

1. A double-pole butting connector comprising:

a male connector having at least one first pole with a first front side and a first back side; and a female connector having at least one second pole with a second front side and a second back side, the first pole and the second pole having an identical thickness, the second pole placed in an insertion groove, and the insertion groove having a positioning strip facing the second back side of the second pole, the positioning strip making contact with the second back side with an allowable deformation angle between the positioning strip and the second back side;

wherein when the first pole of the male connector is inserted into the insertion groove of the female connector, the first front side of the first pole and the second front side of the second pole press against each other.

2. The double-pole butting connector as claimed in claim 1, wherein the male connector utilizes a sleeve to surround the first pole, the female connector utilizes a securing block to pass through the second pole, and an elasticity of the securing block is higher than an elasticity of the sleeve such that the second pole is capable of higher elastic deformation than the first pole.

3. The double-pole butting connector as claimed in claim 1, wherein the male connector utilizes a sleeve to surround the first pole, the sleeve further has a ring framing the first pole, the female connector further comprises a securing block and a connecting set, the securing block passes through the second pole, the connecting set is penetrated by the insertion groove and has a positioning set connected to an enlarged end of the insertion groove; the securing block is secured to the positioning set and presses against an open end of the insertion groove to secure relative positions of the second pole and the positioning strip, and the connecting set of the female connector is inserted in the ring of the male connector.

4. The double-pole butting connector as claimed in claim 3, wherein the sleeve is further provided with an outer threaded section on the ring, an opposite end of the sleeve is mounted with a male end body, an end of the connecting set secured to the securing block is mounted with a female end body jacketed with a nut adjacent to a stopping ring, and the nut is screwed onto the outer threaded section.

5. The double-pole butting connector as claimed in claim 3, wherein the connecting set is jacketed with a sealing ring, the sealing ring is further provided with a sharp ring at an open end, and the sharp ring is configured for squeezing the sealing ring.

6. The double-pole butting connector as claimed in claim 3, wherein the sleeve is provided with a plurality of signal needles, the connecting set is provided with a plurality of through holes having a plurality of signal posts, and when the male connector and the female connector engage together the signal needles and the signal posts are electrically connected.

7. The double-pole butting connector as claimed in claim 3, wherein the sleeve of the male connector is provided with a plurality of signal poles, the connecting set of the female connector is provided with a plurality of square holes having a plurality of communication poles, each square hole is further provided with a stopping bar facing the communication pole; wherein when the male connector and the female connector engage together, the signal poles and the communication poles are electrically connected, and each communication pole presses against the stopping bar to limit flexible deformation between the signal pole and the communication pole.

8. The double-pole butting connector as claimed in claim 1, wherein the allowable deformation angle is defined between the positioning strip and the second pole, and the allowable deformation angle is between 0.5° 4.5°.

9. The double-pole butting connector as claimed in claim 1, wherein the second pole pushes against the first pole, and a free end of the first back side presses against the insertion groove.

10. The double-pole butting connector as claimed in claim 1, wherein the male connector utilizes a sleeve to pass through the first pole, the female connector utilizes a securing block to pass through the second pole, and a length of the second pole protruding from the securing block is longer than a length of the first pole protruding from the sleeve.

* * * * *